United States Patent [19]

Krall et al.

[11] 4,128,122

[45] Dec. 5, 1978

[54] CONTINUOUS CASTING ASSEMBLY

[75] Inventors: Heribert A. Krall, Würzburg; Helmut Maag, Waldbüttelbrunn, both of Germany

[73] Assignee: Technica-Guss GmbH, Würzburg, Germany

[21] Appl. No.: 814,070

[22] Filed: Jul. 8, 1977

[30] Foreign Application Priority Data

Mar. 11, 1977 [DE] Fed. Rep. of Germany ..... 2710680

[51] Int. Cl.[2] ..... B22D 11/10

[52] U.S. Cl. ..... 164/438; 164/443

[58] Field of Search ..... 164/250, 438, 263, 437, 164/438, 439, 442, 443, 418, 82, 136

[56] References Cited

U.S. PATENT DOCUMENTS

| | | | |
|---|---|---|---|
| 1,179,072 | 4/1916 | Chandler | 164/250 |
| 1,736,351 | 11/1929 | Luther | 164/250 X |
| 3,492,918 | 2/1970 | Michelson | 164/263 X |

*Primary Examiner*—Robert L. Spicer

*Attorney, Agent, or Firm*—Jones, Tullar & Cooper

[57] ABSTRACT

A continuous casting assembly including a holding and heating furnace, a mould and cooler, and a strand withdrawal unit is secured to a pivotable frame. The assembly is intended for use in melting and casting small quantities of precious metals such that there is little or no loss or waste of the metal being cast. The furnace, which includes a heated crucible, is adjustably carried on the frame and the mould and cooler form a cover for the crucible. The mould and cooler are pivotably secured to the frame and can be moved to an open position to provide access to the crucible.

4 Claims, 3 Drawing Figures

CONTINUOUS CASTING ASSEMBLY

FIELD OF THE INVENTION

The present invention is directed generally to a continuous strand casting assembly. More particularly, the present invention is directed to such a casting assembly for use in casting small quantities of precious metals. Most specifically, the present invention is directed to a continuous strand casting assembly wherein a holding and heating furnace, which includes a crucible, a mould and cooler, and a strand withdrawal unit are carried on a pivotable frame. The furnace is adjustable on the frame, and the mould and cooler are carried by the frame and can be moved into contact with the open portion of the crucible to form a cover. Once the crucible and mould and cooler are engaged, the frame can be rotated to allow the metal to pass through the mould and to the strand withdrawal unit.

DESCRIPTION OF THE PRIOR ART

Continuous casting systems for metals such as steel and non-ferrous metals such as bronze and brass wherein large quantities of metal are cast in one operation are well known in the prior art. In these systems, it is of minor significance whether metal remains as a sump in the holding furnace and whether the strands cast during the casting operation are of an exact shape. Furthermore, it is economically feasible to use separate melting and holding furnaces when casting large quantities of metals of the types discussed above.

When casting precious metals, however, other considerations have to be made. Precious metals are often processed in small quantities, for instance in quantities of only 5 kg of gold or 5 to 50 kg of silver, depending on the alloy to be made. It is consequently of great economical significance whether all the melted metal can be completely cast or not. Accordingly, it is desirable that no metal remainder be allowed to remain in the crucible and that tail-end loss at the conclusion of casting process also be at a minimum. For reasons of economics and in view of the small quantities of metals used, it is not always possible to invest in separate melting and holding furnaces. Furthermore, primarily small strands with, for instance, 5 mm diameter are desirable. A suitable feeding of the melt to the mould is, therefore, important in order to avoid tearing-off of strands.

SUMMARY OF THE INVENTION

It is the object of the present invention to provide a device for the casting of strands which avoids the shortcomings of the prior devices and prevents metal from remaining in the holding furnace and mould. In the present invention, the holding furnace, the cooler and mould, and the withdrawal unit are mounted on a tiltable frame. The holding furnace includes a melting crucible or can be used as such. Furthermore, a holding and lifting device for the movable combination melting and holding furnace or crucible is provided, and a pivotable mounting plate which carries the cooler and mould also acts as a furnace lid and thus performs a dual function. It is, therefore, possible to connect the crucible with the cooler and mould and to seal them together. The mounting plate for the cooler and mould is equipped with a sealing area which engages the edge of the crucible.

The metal to be processed is first charged into the crucible and is then melted within the crucible. As soon as the metal is melted, a metal refining may take place and the melt is brought to a required casting temperature. During this time, the cooler and mould may be prepared, the pivotable mounting plate which functions as a cover and for attaching the cooler and mould arrangement is pivoted away 180° with reference to the crucible to allow unrestricted preparation of the cooler and mould. The prepared cooler and mould assembly which are carried on the pivotable mounting plate can then be pivoted over the top of the crucible with the mounting plate now functioning as a cover or lid for the crucible. By raising the crucible, which serves as the holding furnace, the crucible is pressed against the sealing area of the cooler mounting plate. The frame can then be rotated from between 90° to 180° in such a manner that the melt can flow into the mould and can be withdrawn in a known fashion by means of a withdrawal unit. The continuous casting process may, for example, start in a horizontal frame position and the pivotable frame may be gradually rotated into a vertical position. It is possible by means of the present invention to continuously cast the metal with no residue.

The positioning of the cooler and mould assembly on top of the crucible may take place before the metal is completely melted. This procedure has the result that the fire resistant sealing and insulating materials can thoroughly dry by means of heat radiation from the melted metal. This avoids generation of gas bubbles at subsequent casting. It is also possible to use the cooler and mould assembly as a lid during inert gas treatment of melts and to avoid considerable heat radiation losses during melting.

The crucible can be heated by any means, but preferably by a medium-frequency induction system. Melting of the metal and treatment of the melt can be performed in a known manner without the danger of damaging the graphite moulds and fireproof insulating and sealing materials. Furthermore, it is not necessary to close the mould during the melting since the discharge opening of the mould will not be in contact with the melt during the melting process. It is, therefore, assured that the melt can properly enter the mould opening, when starting casting process in a known fashion.

To avoid forming of a vacuum in the crucible during the casting, crucibles with a certain gas porosity may be used. It is, furthermore, possible to place in the cover portion of the mounting plate around the cooler a fireproof tube for charging of a gas and/or for compensation of vacuum.

The holding and moving device for the crucible may consist of a threaded spindle guided in a spindle guide secured to the pivotable frame by a steel plate. The spindle engages the melting and holding furnace housing through a disc-spring assembly which may be arranged to control pressure against the crucible housing and to obtain uniform distribution of pressure. The housing of the combination melting and holding furnace, encasing the crucible, may be equipped with a straight guide fitted into two guide-edges attached to the pivotable frame and serving as a retainer for the crucible housing. The crucible is supported in its housing only on top and bottom, permitting an easy exchange required when processing various alloys. The withdrawal unit consists of one driven transport-roller and a non-driven pinch-roller. The pinch-roller or pressure-roller is forced by means of a threaded spindle, spring or a hydraulic or pneumatic cylinder against the strand in a conventional manner.

BRIEF DESCRIPTION OF THE DRAWINGS

While the novel features of the present invention are set forth with particularity in the appended claims, a full and complete understanding of the present invention may be had by referring to the description of a preferred embodiment and as may be seen in the accompanying drawings in which:

DESCRIPTION OF A PREFERRED EMBODIMENT

Figure 1:
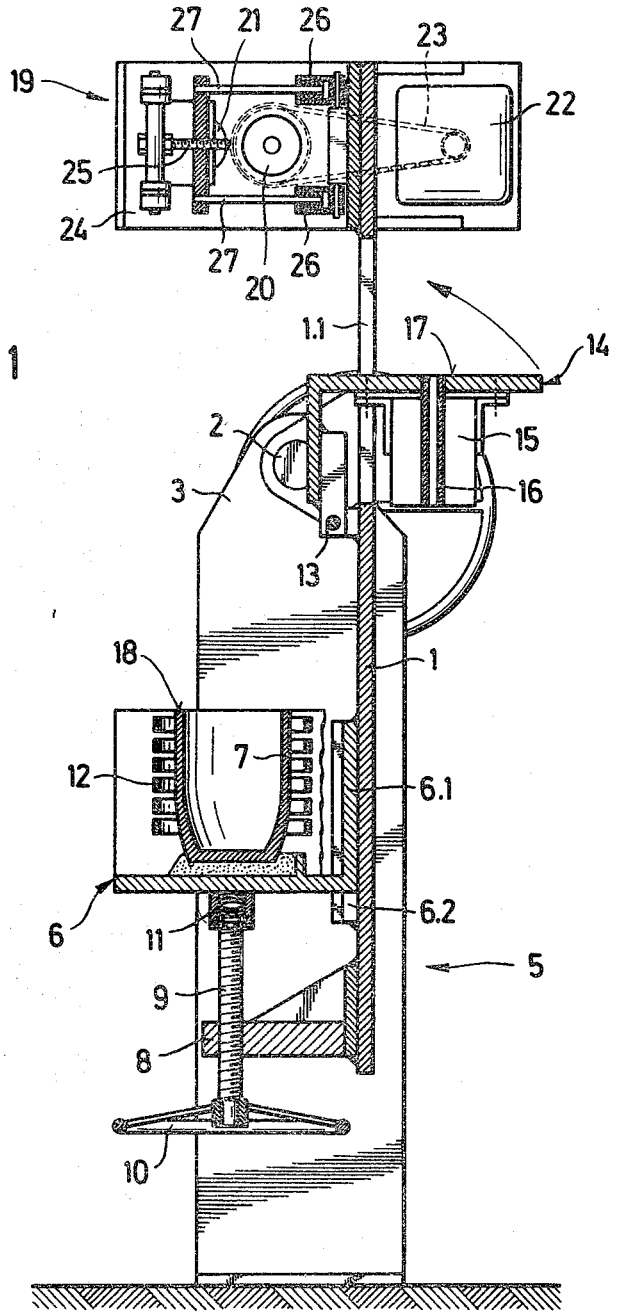
FIG. 1 is a side elevation view, partly in cross section, of a preferred embodiment of a continuous casting assembly in accordance with the present invention, taken along line I—I in FIG. 2 and showing the crucible ready for charging and with the mould and cooler carried by the mounting plate and pivoted 180° away from the crucible.

Turning now to FIG. 1, there may be seen a preferred embodiment of a continuous casting assembly in accordance with the present invention. A generally rectangular frame 1 of suitable metal or the like is pivotably mounted by a pair of shafts 2 to two support uprights 3, as may also be seen in FIG. 2. One of the shafts 2 is rotated manually by a suitable hand wheel and gear reducer assembly indicated generally at 4 in FIG. 2. Actuation of the hand wheel and gear reducer assembly 4 allows the frame 1 to be rotated through 360° about supports 3.

Figure 2:
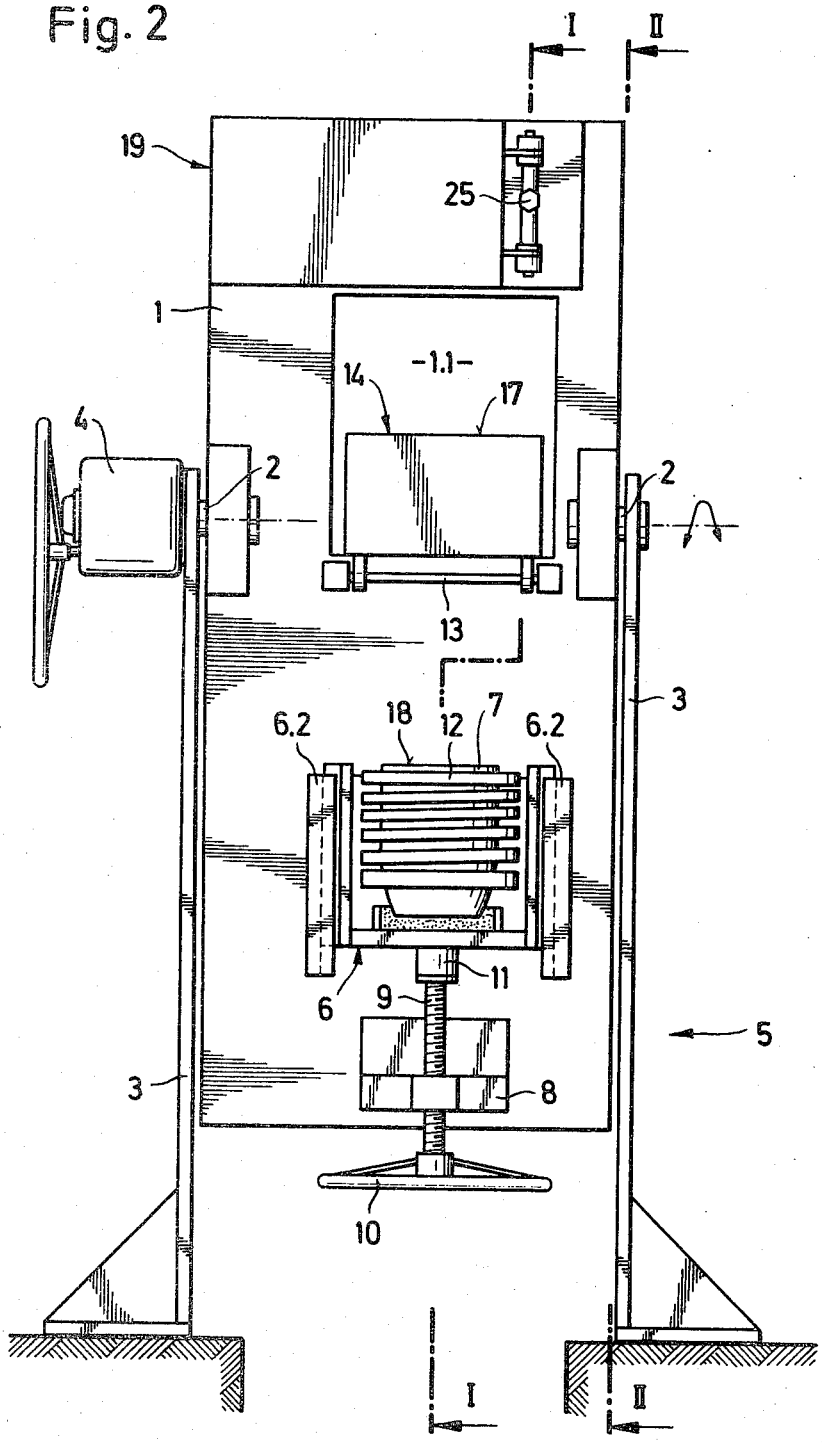
FIG. 2 is a front elevation view of the continuous casting assembly of the present invention.

A holding and lifting device is generally indicated at 5 in FIGS. 1 and 2 and is secured to frame 1. The holding and lifting device 5 supports a holding and melting furnace assembly 6 in which a crucible 7 is arranged. The holding and lifting device 5 is comprised of a spindle guide 8, firmly connected to frame 1, in which a threaded spindle 9 is supported. Threaded spindle 9 can be actuated by a handwheel 10, and a disc-spring column 11 is arranged between the threaded spindle 9 and the holding furnace assembly 6. The crucible 7 is surrounded by an electrical heating coil 12 and encased by the holding furnace assembly 6. The holding furnace assembly 6 is equipped with a guide 6.1, which in turn is fastened to two spaced guide strips 6.2 secured to pivotable frame 1.

Referring to FIG. 2, an axle 13 is fixedly secured to frame 1 and carries a mounting plate assembly 14 for pivotable motion of up to 180° about axle 13 through an opening 1.1 in frame 1. A cooler 15 and a mould 16 are secured to mounting plate assembly 14 by any suitable means. A portion of the mounting plate assembly 14 forms a lid having a sealing surface 17 which contacts the open mouth of the crucible 7 as will be discussed hereinafter. Both the cooler 15 and the mould 16 are conventional and need not be discussed in further detail.

Figure 3:
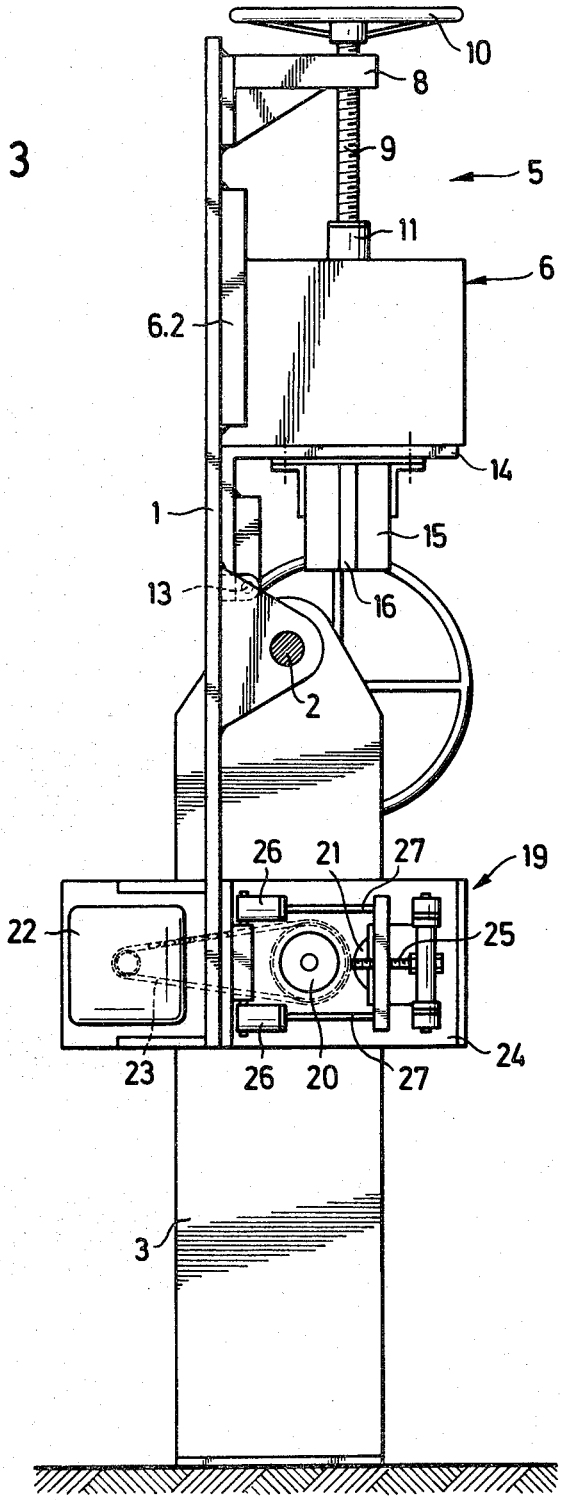
FIG. 3 is a side elevation view of the continuous casting assembly taken along line II—II in FIG. 2 and showing the assembly in a casting position with the mould and cooler and their mounting plate contacting the crucible and with the assembly being rotated 180° from the position shown in FIG. 1.

In operation, the threaded spindle 9 is retracted by actuating handwheel 10 so that the furnace assembly 6 and crucible 7 which is in a vertical position on frame 1 as illustrated in FIG. 1 and FIG. 2 can be easily charged with metal. The mounting plate assembly 14 for cooler 15 and mould 16 is pivoted around 180° so that cooler 15 with mould 16 can be easily attached or exchanged and sealing surface 17 can be prepared. After a charge of metal is put into crucible 7 and is heated by means of electrical heating, preferably operating according to the medium-frequency induction system, the mounting plate assembly which carries the cooler 15 and mould 16 is rotated around axle 13 by 180° and functions as a lid for crucible 7. The mounting plate assembly will be thereafter fixed by means of swivel screws, not shown, onto frame 1 and furnace assembly 6 with crucible 7 moved subsequently upwards by means of a threaded spindle 9 and handwheel 10 in order to achieve a forced sealing of crucible edge 18 to sealing surface 17 of mounting plate assembly 14. Thereafter, frame 1 may be rotated 180° into an inverted vertical position as may be seen in FIG. 3, prior to initiating the casting process in a known fashion. The frame 1 can also be rotated into a horizontal position so that horizontal continuous casting in known fashion can be produced. It is also possible to select any intermediate position between the two above-described positions so that a state between vertical and horizontal continuous casting can be achieved or a gradual rotation to a vertical position may take place.

The withdrawal of a strand or of simultaneously cast multiple strands is achieved by means of a withdrawal device 19, attached to frame 1 and consisting of a transport roller 20, and an opposed arranged pressure roller 21, whereby the transport roller 20 is driven by a motor 22 through a chain 23. The transport roller 20 is mounted in a pillowblock 24. The pressure roller 21 is adjustably arranged and is pressed by means of disc spring columns 26 over a threaded rod 25 and two arms 27 uniformly onto the strand or strands. The pressure exerted by means of the threaded rod 25 and the deflection of disc spring columns 26 is adjustable by any suitable means. Furthermore, if desired, a strand guide or a strand coiling device with cut-off unit (not shown) may be mounted on frame 1.

It will thus be seen that there has been hereinabove fully and completely described a preferred embodiment of a continuous casting assembly in accordance with the present invention which is particularly adapted for use with small quantities of precious metals and which results in the complete melting and casting of the metal with little or no residue or waste. It will be obvious to one of skill in the art that a number of changes in, for example, the shape of the frame, the specific pivotal mounting means, the type of heater used and the like could be made without departing from the true spirit and scope of the present invention and accordingly the invention is to be limited only by the appended claims.

We claim:

1. A continuous casting assembly for use in casting small quantities of precious metals, said casting assembly comprising:

a holding furnace slidably secured to a pivotable frame, said furnace including a heatable crucible;

a cooler and mould carried on a mounting plate assembly pivotally secured to said frame, a portion of said mounting plate assembly being provided with a sealing surface for engagement with a mouth portion of said crucible when said mounting plate assembly is pivoted into contact with said crucible;

means for raising and lowering said holding furnace on said frame, said means including a threaded spindle passing through a spindle guide secured to said frame, said spindle contacting said furnace through a disc-spring column to raise and lower said furnace on said frame, said furnace having a guide which slidably engages guide strips carried on said frame;

a withdrawal device for a strand cast by said continuous casting assembly, said withdrawal device being carried by said frame; and means for pivoting said frame whereby said holding furnace and said mould and cooler carried by said mounting plate assembly, whose sealing surface has been brought into engagement with said mouth of said crucible, can be pivoted to cause flow of melted metal through said cooler and mould to said withdrawal device.

2. The continuous casting assembly of claim 1 wherein said crucible is heatable by means of a medium frequency induction heating system.

3. The continuous casting assembly of claim 1 wherein said crucible consists of a gas-porous material.

4. The continuous casting assembly of claim 1 wherein said mounting plate assembly is equipped with a fire-proof tube for gas transmission.

* * * * *